US006082735A

United States Patent [19]

Kintner

[11] Patent Number: 6,082,735

[45] Date of Patent: Jul. 4, 2000

[54] METHOD OF PLAYING GAME

[76] Inventor: Robert J. Kintner, P.O. Box 1226, Port Washington, N.Y. 11050

[21] Appl. No.: 09/172,169

[22] Filed: Oct. 14, 1998

Related U.S. Application Data

[63] Continuation-in-part of application No. 08/901,665, Jul. 28, 1997, abandoned.

[51] Int. Cl.[7] ..... A63F 3/02

[52] U.S. Cl. ..... 273/261

[58] Field of Search ..... 273/260, 261

[56] References Cited

U.S. PATENT DOCUMENTS

| | | | |
|---|---|---|---|
| 511,773 | 1/1894 | Higgins | 273/260 |
| 694,509 | 3/1902 | Winckfield | 273/261 |
| 2,614,842 | 10/1952 | Rice | 273/261 |
| 5,636,841 | 6/1997 | Burroughs | 273/260 |

FOREIGN PATENT DOCUMENTS

| | | | |
|---|---|---|---|
| 7001 | 4/1892 | United Kingdom | 273/260 |

*Primary Examiner*—Benjamin H. Layno
*Attorney, Agent, or Firm*—Fitzpatrick, Cella, Harper & Scinto

[57] ABSTRACT

A game playing method for two or more players utilizes a game board of a generally cross-shaped playing area having a checkerboard pattern. Each player is provided with a set of twelve game pieces numbered 1 through 12. The game is played by players moving either forward or backward in diagonal directions. A player may jump any game piece as long as the game piece being jumped is ranked with a number equal to or less than that of the jumping game piece. The object of the game is to jump and capture the opposition's number 12 game piece(s).

21 Claims, 5 Drawing Sheets

METHOD OF PLAYING GAME

This is a continuation-in-part application of U.S. patent application Ser. No. 08/901,665, filed Jul. 28, 1997, now abandoned.

BACKGROUND OF THE INVENTION

The present invention relates to a method of playing a board game by two or more players who take turns moving game pieces in order to capture the game pieces of the other players. More particularly, the present invention relates to a method of playing a checkers-type game where the game pieces are marked with ranking indicia to determine whether one game piece can capture another.

The game of checkers is a well-known board game played on an eight-by-eight square board of two colors, with diagonally adjacent squares being of the same color. One player uses twelve game pieces of one color and the opposing player uses game pieces of a different color. The game pieces are normally of a shallow disk shape and are permitted to move diagonally forward, i.e., toward the opponent's side one square at a time. If a first player's game piece is diagonally adjacent to the opponent's game piece, the first player's game piece may "jump" the opponent's game piece as long as he can land in an aligned square. If, in such a move, the first player's game piece lands adjacent another game piece of the opponent, he can jump that game piece in the same turn as long as the next square in line is unoccupied. A player must jump the opponent's game piece if possible. If a player's game piece reaches the opponent's back row, then that game piece is "kinged" or "crowned", such that it can move in any diagonal direction. The object of checkers is to capture or block all of the opponent's game pieces. However, each game piece is of an equal rank, thus limiting the strategy of the game. Moreover, checkers is not practicable to play with more than two players.

Chess is a more complicated board game of ancient origin. Unlike checkers, each player in chess utilizes sixteen pieces or "chessmen" consisting of eight pieces and eight pawns. Also, the chessmen can occupy squares of both colors. Each player moves his chessmen according to fixed types of movements across the board. The object is to checkmate the opponent's "king" game piece. However, although the chessmen may be considered to be ranked, the lowest ranked game piece, the pawn, can take the highest ranked game piece, the king. Also, as in checkers, chess is not practicable to play with more than two players.

Other games have been developed based on the traditional games of checkers and chess. For example, U.S. Pat. No. 2,066,244 to Bates relates to a game apparatus including a game board based on a checkerboard including two eight-by-eight playing areas disposed on opposite sides of a reduced two-by-four playing area. The game pieces are numbered from 1 to 12. Each player endeavors to secure a certain number, for example, 70, resulting from adding the numerals on the game pieces that are taken. Four persons may play the game, with partners being seated on the same side of the board. Suitable rules may be made such that partners' game pieces may cross from one board to the other board, or game pieces can be surrendered from one partner to another.

U.S. Pat. No. 5,116,062 to Johnson relates to a board game using a checkerboard of ten rows of eight squares each. Each player uses twelve game pieces numbered 1 through 12 with each game piece also including a mathematical symbol for addition, subtraction, multiplication or division. The game is played much like checkers with the players moving forward, jumping, removing jumped pieces and becoming a king. Points are scored for not only winning the game, but also for performing the mathematical function represented by each jump.

U.S. Pat. No. 5,306,016 to McInnis relates to a method of playing a game for two players and including both a board having rows and columns of squares and consecutively numbered playing tokens. A rule of the game is that a player's token may jump an opponent's token that is occupying an adjacent square forward, diagonally forward, or on the side thereof, only if the number of the player's token and the number of the opponent's token multiply to an even number. The object of the game is for a player to advance the number 10 token to the opponent's end of the board or to capture the opponent's number 10 token.

BRIEF SUMMARY OF THE INVENTION

An object of the invention is to provide an entertaining game that is fast-paced like checkers, but involves more in-depth strategy.

Another object of the invention is to provide a fast-paced game like checkers, but which can be practicably played by more than two players.

In one aspect of the invention, a method of playing a board game by a plurality of players includes the step of providing a game board divided into rows of alternate playing and non-playing squares of respectively contrasting colors or other form of distinguishing indicia and a plurality of game pieces for each player. Each of the game pieces for each player includes ranking indicia. The method further includes the steps of arranging the game pieces of a first player on the playing squares of a plurality of rows at one end of the game board, and arranging the game pieces of an opposing, second player on the playing squares of a plurality of rows at another end of the game board. Play begins by having the first player move a first game piece diagonally to a contiguous, unoccupied playing square or jumping the first game piece of the first player diagonally over a second game piece of the first player, the second game piece of the first player being of a rank equal to or lower than the rank of the first game piece, and into an unoccupied playing square. A first game piece of the second player is moved diagonally to a contiguous, unoccupied playing square or the first game piece of the second player is jumped diagonally over a second game piece of the second player, the second game piece of the second player being of a rank equal to or lower than the rank of the first game piece of the second player, and into an unoccupied playing square. The method further includes repeating the prior two steps with the additional move option of moving another game piece diagonally to a contiguous, unoccupied playing square or jumping the other piece diagonally over any game piece of a rank equal to or lower than the rank of the other game piece and into an unoccupied playing square while removing any game piece jumped by an opponent's game piece.

In another aspect of the invention, a method of playing a board game by a plurality of players includes the step of providing a game board divided into rows of alternate playing and non-playing squares and having plural sides and a plurality of sets of game pieces. Each of the game pieces includes ranking indicia. The method further includes the steps of arranging a first set of the game pieces on the playing squares at a first side of the game board, arranging a second set of the game pieces on the playing squares at a second side of the game board opposite the first side, the game pieces of the first and second sets being of a first team, arranging a third set of the game pieces on the playing squares at a third side of the game board and arranging a fourth set of the game pieces on the playing squares at a fourth side of the game board opposite the third side, the game pieces of the third and fourth sets being of a second team. To begin play, the first team moves a first game piece diagonally to a contiguous, unoccupied playing square or jumps the first game piece of the first team diagonally over a second game piece of the first team, with the second game piece of the first team being of a rank equal to or lower than the rank of the first game piece, and into an unoccupied playing square. The method also includes the steps of moving a first game piece of the second team diagonally to a contiguous, unoccupied playing square or jumping the first game piece of the second team diagonally over a second game piece of the second team, with the second game piece of the second team being of a rank equal to or lower than the rank of the first game piece of the second team, and into an unoccupied playing square, and repeating the prior two steps with the additional move option of moving another game piece diagonally to a contiguous, unoccupied playing square or jumping the other game piece diagonally over any game piece of a rank equal to or lower than the rank of the other game piece and into an unoccupied playing square while removing any game piece jumped by an opposing team's game piece.

In yet another aspect of the invention, a method of playing a board game by a plurality of players includes the step of providing a game board divided into rows of alternate playing and non-playing squares and having plural sides and a plurality of sets of game pieces. Each of the game pieces includes ranking indicia. The method further includes the steps of arranging a first set of the game pieces of a first player on the playing squares at a first side of the game board, arranging a second set of the game pieces of a second player on the playing squares at a second side of the game board opposite the first side, arranging a third set of the game pieces of a third player on the playing squares at a third side of the game board, and arranging a fourth set of the game pieces of a fourth player on the playing squares at a fourth side of the game board opposite the third side. To begin play, the first player moves a first game piece diagonally to a contiguous, unoccupied playing square or jumps the first game piece of the first player diagonally over a second game piece of the first player, the second game piece of the first player being of a rank lower than the rank of the first game piece of the first player, and into an unoccupied playing square. The method also includes the steps of moving a first game piece of the second player diagonally to a contiguous, unoccupied playing square or jumping the first game piece of the second player diagonally over a second game piece of the second player, the second game piece of the second player being of a rank lower than the rank of the first game piece of the second player, and into an unoccupied playing square; moving a first game piece of the third player diagonally to a contiguous, unoccupied playing square or jumping the first game piece of the third player diagonally over a second game piece of the third player, the second game piece of the third player being of a rank lower than the rank of the first game piece of the third player, and into an unoccupied playing square; and moving a first game piece of the fourth player diagonally to a contiguous, unoccupied playing square or jumping the first game piece of the fourth player diagonally over a second game piece of the fourth player, the second game piece of the fourth player being of a rank lower than the rank of the first game piece of the fourth player, and into an unoccupied playing square. The game playing method is continued by repeating the prior four steps with the additional move option of moving another game piece diagonally to a contiguous, unoccupied playing square or jumping the other game piece diagonally over any game piece of a rank equal to or lower than the rank of the other game piece and into an unoccupied playing square while removing any game piece jumped by an opposing player's game piece.

These and other objects, aspects, features and advantages of the present invention will become apparent from the following detailed description of the preferred embodiments taken in conjunction with the accompanying drawings.

DESCRIPTION OF THE PREFERRED EMBODIMENTS

Figure 1:
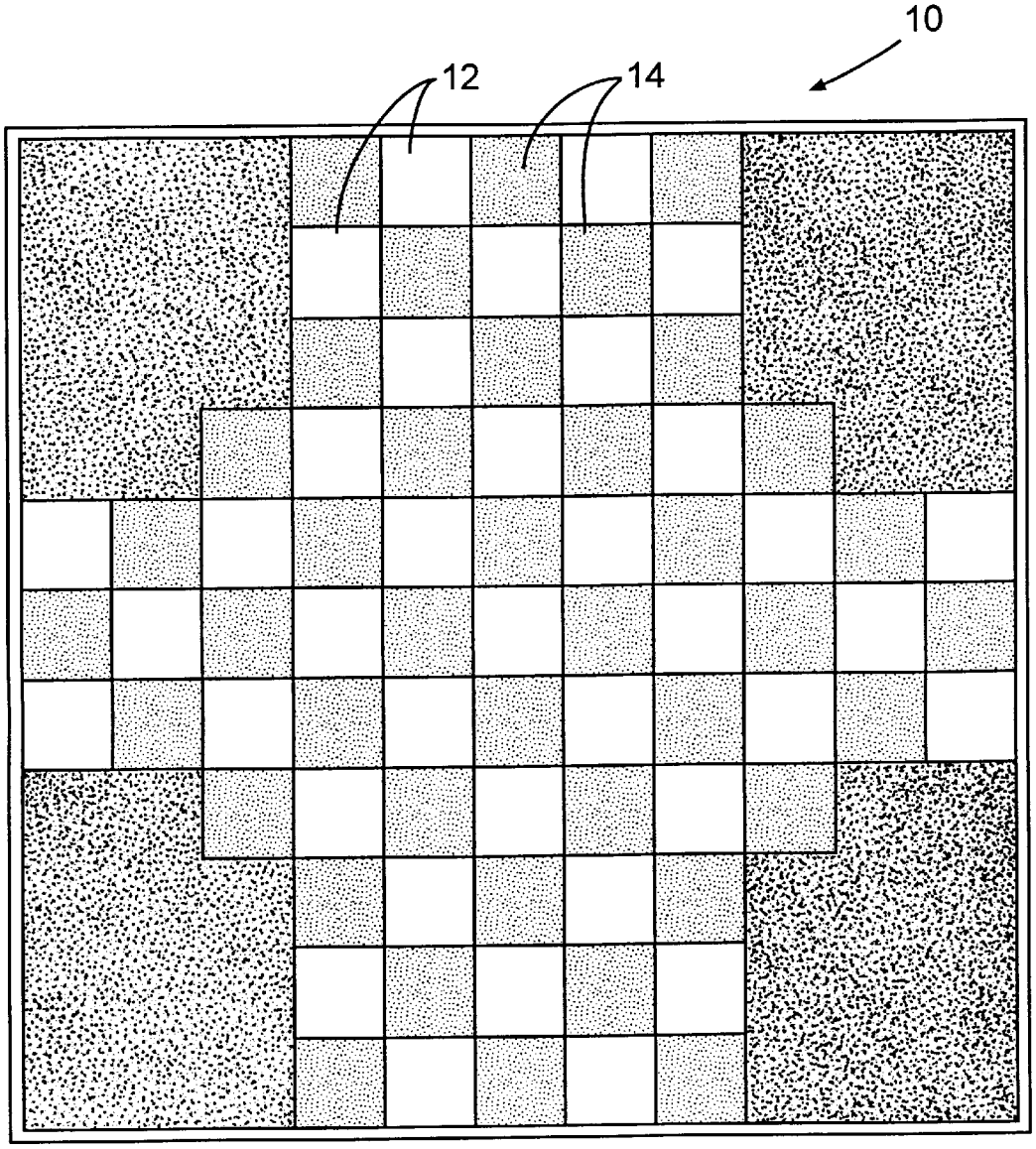
FIG. 1 is a plan view of the game board used in a first embodiment of the game playing method of the present invention.

The game playing method of the present invention will be described herein by referring to the elements of the game apparatus, namely the game board and the set of game pieces. Referring to FIG. 1, the game board for use in a first embodiment will be described. The game board 10 is formed in the shape of a square. A plurality of smaller squares 12, 14 aligned in rows (from left to right in the figure) and columns (from top to bottom in the figure) are formed on the game board. The squares 12, 14 are of two different colors, such that diagonally adjacent squares are of the same color, but vertically and horizontally adjacent squares are of different colors. That is, squares in each row are of alternate colors and squares in each column are of alternate colors.

In the preferred embodiments, the playing area of the game board is of a generally cross-like or cruciform shape. The darker squares 12 are deemed "playing squares" and the lighter squares 14 are deemed "non-playing squares." The playing squares of the board in the first embodiment can be red and the non-playing squares black, for example.

As shown in FIG. 1, there are eleven rows and eleven columns on the game board used in the first embodiment. Rows 1 through 3 and 9 through 11 have five total squares each, with two or three of those total five squares being of one color. Rows 4 and 8 have seven total squares each, four of which are playing squares and three of which are non-playing squares. Rows 5, 6 and 7 extend the entire width of the board and include eleven squares each, with five or six of those squares being playing squares.

Columns 1, 2, 10 and 11 each include three total squares, one or two of which are playing squares. Columns 3 and 9 each include five total squares, three of which are playing squares and two of which are non-playing squares. Columns

4 through 8 extend the entire height of the board and each have eleven total squares, five or six of which are playing squares.

The four corners of the board are not used for play, but can include decorative designs, logos, or the rules of play.

In one example of the first preferred embodiment, the squares of the game board have one inch sides such that the entire game board measures 11×11 inches. The game board can include preformed folds such that the corners can fold in toward the center of the board when not in use. Thus, the board can be folded to a smaller size, for example, 8×8 inches, to minimize the size of its storage box. Other shapes and sizes for the board may be used. Also the board can be in the form of a foldable case, which can be molded.

Although the board is shown as a set of squares, the invention is not limited to this design. For example, the board can be divided into a plurality of circles, triangles or diamonds, as long as they are aligned in rows and columns.

Figure 2:
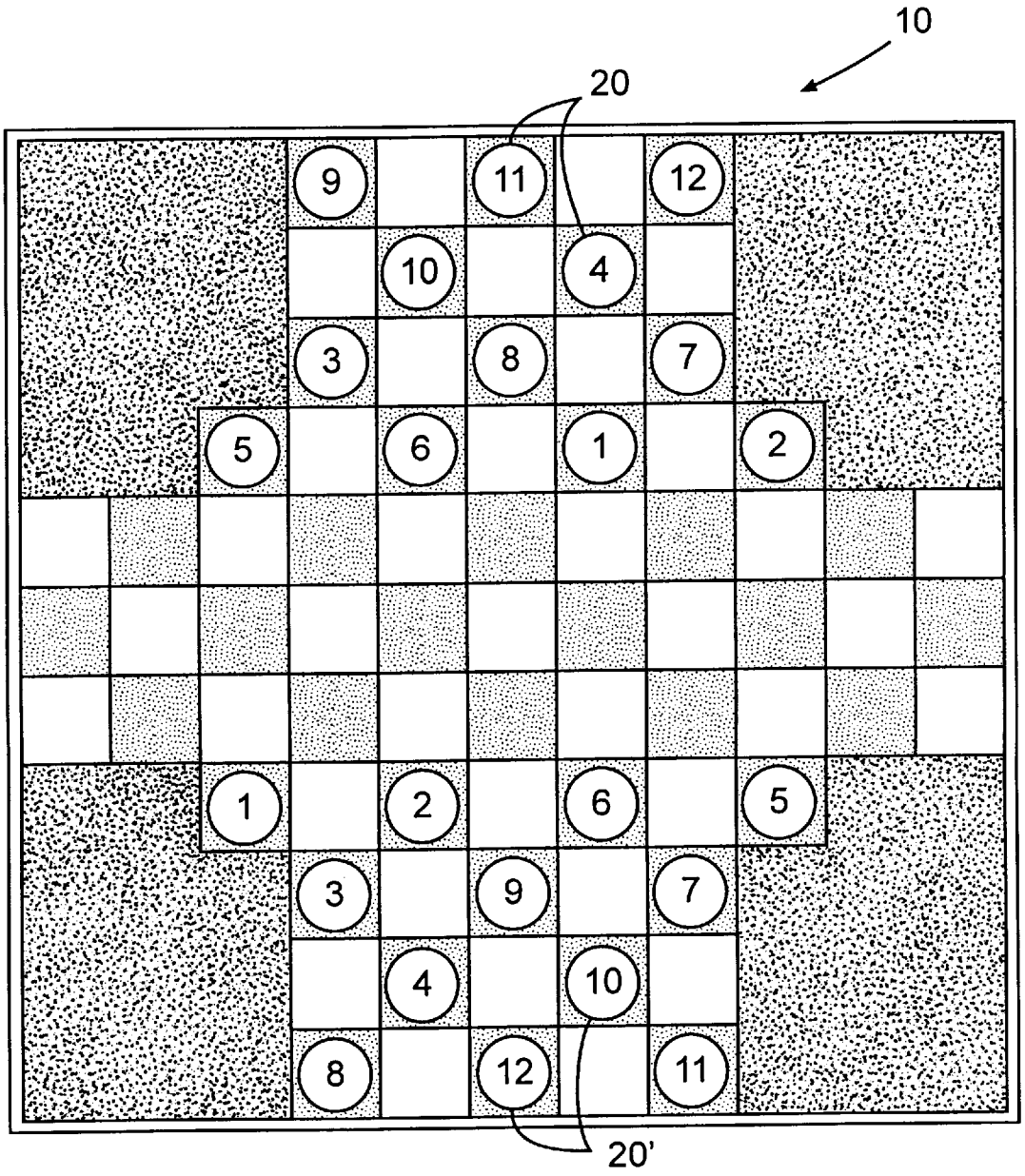
FIG. 2 is a plan view of the game board used in the first embodiment of the game playing method of the present invention, set up to play under a first scheme.
Figure 3:
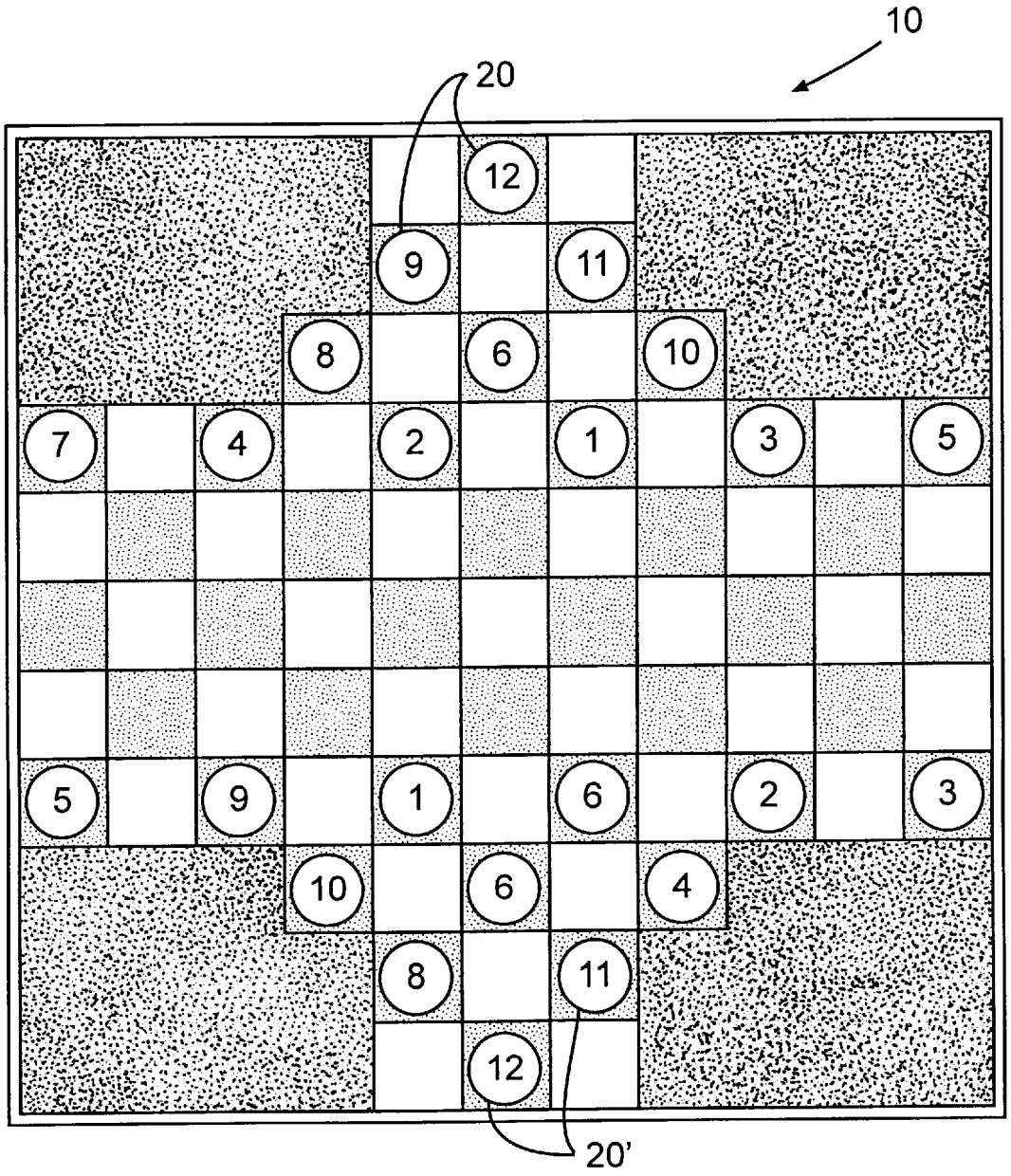
FIG. 3 is a plan view of the game board used in the first embodiment of the game playing method of the present invention, set up to play under a second scheme.

In the first embodiment, as shown in FIGS. 2 and 3, one player's set of game pieces includes twelve pieces 20, all of one color, and which are individually and consecutively numbered 1 through 12. The opposing player's set of game pieces 20' are similar, but are of a different color than the first set of game pieces. The first set of game pieces can be red and the second set of game pieces black, for example. The game pieces are preferably in the form of a disk, but are not limited to such a shape. For example, numbered pegs fitting in holes in the board, for travel purposes, may be used.

The object of the play of the game is to capture the number 12 (highest ranked) playing piece of the opponent. A playing piece is "captured" when it is "jumped" by an opponent's playing piece.

The parameters of the game playing method of the first embodiment, which is preferably played by two opposing players, will now be described. Playing pieces are permitted to move only diagonally from one playing square to an adjacent playing square unless a jump is made, as will be described below. The move can be either toward the opponent's side of the board or toward the player's side of the board.

A player can jump any game piece, both an opponent's game piece or another game piece of the player. Jumps are permitted if the game piece being jumped is of a number or rank equal to or less than the number of the jumping game piece, if the game piece being jumped is in a playing square contiguous to the square in which the jumping piece originates, and if there is an unoccupied square directly in line with the jumping piece and the piece to be jumped such that the jumping piece can land in the unoccupied square after jumping the jumped piece. Also, only the highest ranked game piece (e.g., the 12) can capture the opponent's highest ranked game piece (e.g., the 12).

When a jumping piece is in a playing square after having jumped one game piece of the opponent, the jumping piece can make one or more additional jumps in a single turn as long as the above-described criteria for jumping are satisfied. The player moving the jumping game piece then removes the jumped game piece from the playing area if the jumped game piece is of the opponent.

It is mandatory that a player's game piece jump an opponent's game piece if a jump is possible. If more than one jump possibility exists, the player has the option of selecting any one jump of his or her choice. A player is not required to jump his or her own game piece even if such a jump possibility exists. However, if a player jumps his own game piece and there subsequently arises a jump possibility of an opponent's game piece, the player must jump the opponent's game piece.

The method of playing the game according to the first embodiment will now be described in detail. Play of the game begins with both the player's and the opponent's game pieces being set up in the scheme shown in FIG. 2. Although each player must start the game with his or her set of game pieces in the 3-2-3-4 pattern shown in FIG. 2, the individual game pieces need not be arranged in the same order shown in the figure. That is, although three game pieces must originally be placed in the back row, they need not be game pieces "8", "12" and "11".

A designated player then moves first. One option for the first player is to move any game piece 20 in the fourth row diagonally forward one space. Alternatively, the first player can move a game piece 20 from the third row such that it diagonally jumps a game piece in the fourth row into an open space. However, the game piece in the third row must have a higher rank than the game piece in the fourth row for a jump to be permitted. That is, the game piece in the third row must have a higher number than the game piece in the fourth row. The second (opposing) player then moves one of his playing pieces 20' using one of the two options described above.

Players then alternate taking turns within the above-described parameters until one player jumps and captures the opponent's "12" game piece. That player is declared the winner. The game ends in a draw either when both players have only their "12" game pieces remaining on the board or one player has a "12" game piece and the other player has both a "12" game piece and one other playing piece remaining on the board.

For a variation of the game, the board can be turned 90° and the game pieces set up in the scheme shown in FIG. 3. That is, the board is set up in a 1-2-3-6 pattern for each player. The rules of the game are the same in this embodiment, with the object being to capture the opponent's "12" game piece.

It should be noted that the game board 10 is not to be limited to the design shown in FIG. 1. Although such a game board presents a unique challenge to the method of playing the game, the game can also be played on a standard checkers game board with an eight-by-eight square design or with eight-by-twelve or six-by-twelve square designs.

Also, the ranking indicia on the game pieces 20, 20' need not be limited to numerals. Any other suitable ranking sequence can be used, such as the alphabet, playing card values, dollar denominations or military ranks. It is also possible to have each playing piece labelled with one ranking sequence on one side and another ranking sequence on the other. For example, a game piece can have a numeral from 1 to 12 on one side and a corresponding one of twelve military ranks on the other.

In another preferred embodiment of the present invention, the game playing method is for use by preferably two to four players, and optionally can be played with at least one player on each of two opposing teams. With two players, each player would be on an opposing team; with three players, one player would be on one team and two on the other; and with four players, two players would be on each team or all four players would play individually. The second embodiment will be described also referring to the elements of the game apparatus, namely a modified game board and sets of game pieces.

Figure 4:
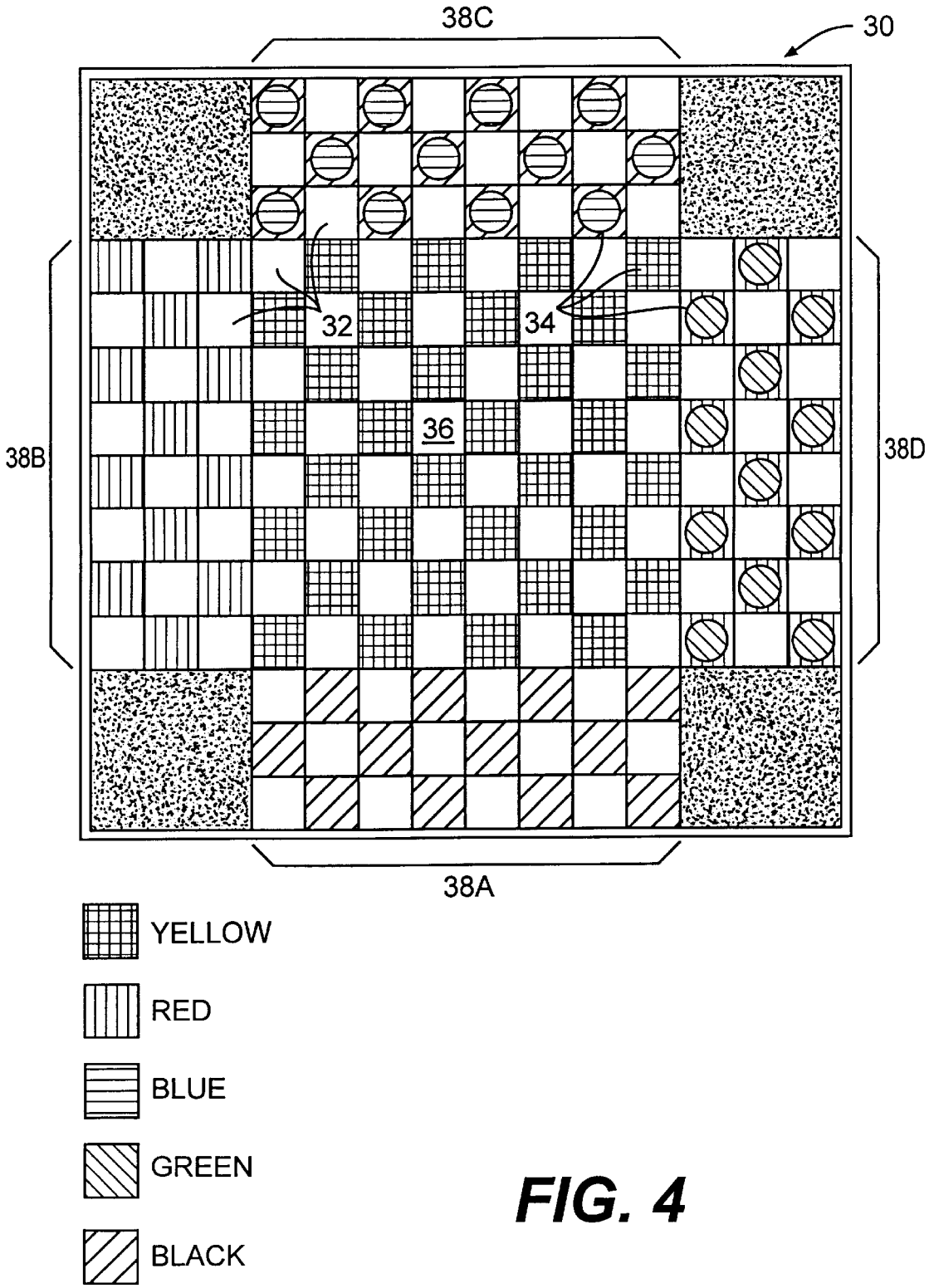
FIG. 4 is a plan view of the game board used in a second embodiment of the game playing method of the present invention.

Referring to FIG. 4, the game board 30 for use in the second embodiment will be described. Unlike game board 10 for use with the first embodiment, which is symmetrical only about one axis, game board 30 of the second embodiment is symmetrical about both axes. That is, each row (from left to right in the figure) has a corresponding column (from top to bottom in the figure) having an identical number of smaller squares 32, 34. Moreover, the squares 32, 34 in the game board 30 of the second embodiment are preferably of more than two different colors. Of course, the board is not to be limited to any particular color scheme.

As shown in FIG. 4, the playing area of game board 30 is of cruciform shape including a common playing area 36 substantially square in shape and four starting areas 38A–38D, each of which is disposed adjacent one side of common playing area 36 and is substantially rectangular in shape. The non-playing squares 32 in game board 30 are disposed diagonally adjacent one another and each is of a uniform color, such as white. The playing squares 34 in common playing area 36 are all of the same color, such as yellow, but playing squares in each of the four starting areas 38A–38D preferably differ in color from one another. For example, the playing squares in starting area 38A can be solid black whereas those of starting area 38C, directly across common playing area 36, can be a blue circle on a black field. If team play is desired, starting areas 38A and 38C are utilized by players on the same team. The playing squares in starting areas 38B and 38D for the opposing team can be solid red on one side of the board and green circles on red fields on the opposite side of the board.

Common playing area 36 of game board 30 is preferably of an eight-by-eight grid whereas each starting area 38A–38D is preferably of a three-by-eight grid. Therefore, the preferred game board 30 consists of fourteen columns, with the eight central columns being fourteen squares long and the three columns on either side of the central columns being eight squares long. The game board 30 also includes similarly disposed rows of a corresponding number of squares. Accordingly, if one-inch playing and non-playing squares are used, game board 30 will be a substantially fourteen-by-fourteen inch square. Of course, the game board 30 is not to be limited to the described arrangement and size.

As in the first embodiment, the four corners of game board 30 are not used for play, but can include decorative designs, logos or the rules for play. Also, game board can include preformed folds such that the corners can fold in toward the center of the board when not in use, so as to store game board 30 in a smaller size. Alternatively, the board can be in the form of a folded case. Further, game board 30 is not limited to sets of squares, but can be divided into a plurality of circles, triangles, diamonds, or other geometric shapes, as long as they are aligned in rows and columns.

As in the first embodiment, in the method of play of the second embodiment, each player's set of game pieces includes twelve pieces, all of one color, and which are individually and consecutively numbered 1 through 12. However, in the second embodiment, there are four sets of game pieces 40A–40D, two sets for each team when team play is desired. The first set of game pieces 40A can be black with the second set 40C of the same team being blue. The third set of game pieces 40B can be red with the fourth set 40D of the same team being green. The sets of game pieces can be distinguished in ways other than differing colors. For example, the different sets of game pieces can be of different shapes. Also, if playing card values are used as the ranking indicia, each player can use game piece sets of a different card suit.

As in the first embodiment, the object of the play of the game in the second embodiment is to capture the number 12 (highest ranked) playing pieces of the opposing team. Because each team has two sets of playing pieces, the object is to capture two number 12 playing pieces. When individual play is desired, the object is to have the last number 12 playing piece left on the board.

The parameters of the game playing method of the second embodiment are similar to those of the first embodiment, with certain modifications. Like the first embodiment, playing pieces are permitted to move only diagonally from one playing square to an adjacent playing square unless a jump is made. Moves can be made in any diagonal direction. Players can jump any game piece, either an opponent's game piece, a teammate's game piece or another game piece of the player. Jumps are only permitted if the game piece being jumped is of a number or rank equal to or less than the number of the jumping game piece. If a player jumps his own game piece or a game piece of his teammate (during team play), the jumped game piece is not removed from the board. Only jumped game pieces of the players of the opposing team are removed. Multiple jumps can be made according to the criteria described in the first embodiment. Although a player's game piece must jump an opponent's game piece if a jump is possible, a jump is not required if the game piece to be jumped is the player's or his teammate's game piece.

Figure 5:
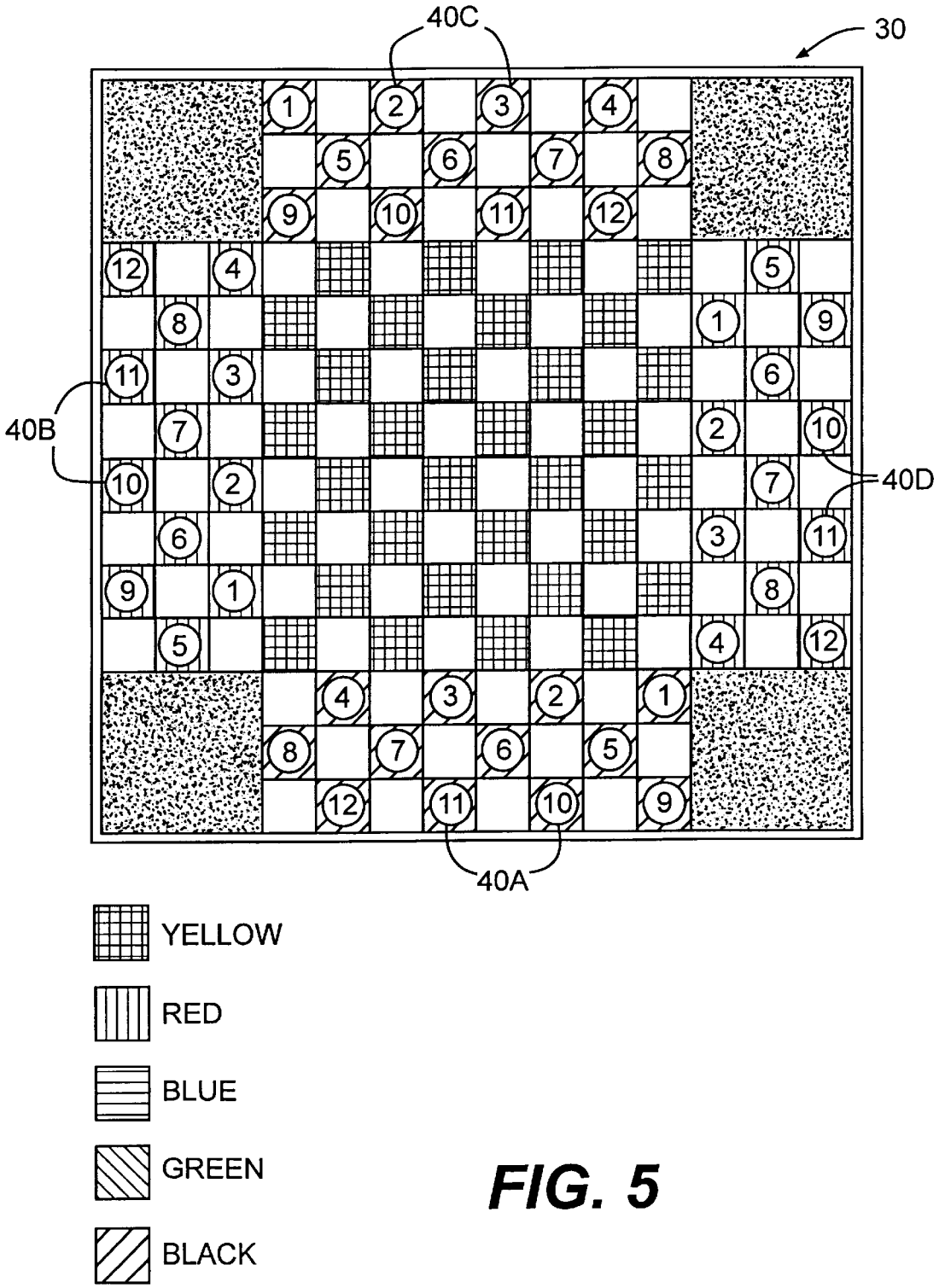
FIG. 5 is a plan view of the game board used in the second embodiment of the game playing method of the present invention, set up to play under a preferred scheme.

The method of playing the game according to the second embodiment will now be described in detail. The play of the game begins with each player setting up his or her game pieces in the scheme shown in FIG. 5. Black game pieces 40A are initially set up in starting area 38A of solid black squares, red playing pieces 40B in starting area 38B of solid red squares, blue playing pieces 40C in starting area 38C of squares having blue circles on black fields, and green playing pieces 40D in starting area 38D of squares having green circles on red fields. Although each player must start the game with his or her set of game pieces in the 4-4-4 pattern shown in FIG. 5, the individual game pieces need not be arranged in the same order shown in the figure.

Play preferably begins with the player playing red playing pieces 40B and moves clockwise to the players playing blue playing pieces 40C, green playing pieces 40D and black playing pieces 40A. Starting moves are similar to those described with regard to the first embodiment, with jumps being permitted only when a lower-ranked game piece is jumped. Players continue taking turns in a clockwise direction within the described parameters until no other moves are available, both of one team's "12" game pieces are captured (team play), or only one "12" game piece remains on the board (individual play). The capturing team is declared the winner. If during play any player is blocked from moving any of his or her game pieces, that player must remove one of the remaining game pieces from the game board. If all pieces of one color are removed from the game board, play continues in the same clockwise rotation, but bypassing the player who no longer has any playing pieces on the board.

As an alternative objective in the second embodiment of the present invention, especially during individual play, the winner can be that person who has either captured the most pieces or the player having the highest cumulative value of captured pieces. That is, even if one player's "12" game piece is never captured, he or she is not necessarily the winner because another player may have captured more game pieces or a higher cumulative value of game pieces. If used in a gambling establishment and dollar denominations are the ranking indicia, each player would have to pay off the equivalent amount of his or her captured game pieces to the opposing player who has captured those game pieces.

While the present invention has been described as to what is currently considered to be the preferred embodiments, it is to be understood that the invention is not limited to them. For example, the game may be adapted to a computerized game where two or more players may play each other on a computer screen, or one or two players may play against the computer. To the contrary, the invention is intended to cover various modifications and equivalent arrangements within the spirit and scope of the appended claims. The scope of the following claims is to be accorded the broadest interpretation so as to encompass all such modifications and equivalent structures and functions.

I claim:

1. A method of playing a board game by a plurality of players, said method comprising the steps of:

providing a game board divided into rows of alternate playing and non-playing areas and a plurality of game pieces for each player, wherein the came board comprises six rows of five total areas, two rows of seven total areas, and three rows of eleven total areas, each playing area being diagonally adjacent to at least one other playing area, and each of the game pieces for each player comprises ranking indicia;

arranging the game pieces of a first player on the playing areas of a plurality of rows at one end of the game board;

arranging the game pieces of an opposing, second player on the playing areas of a plurality of rows at another end of the game board;

beginning play by having the first player move a first game piece diagonally to a contiguous, unoccupied playing area or jumping the first game piece of the first player diagonally over a second game piece of the first player, the second game piece of the first player being of a rank equal to or lower than the rank of the first game piece, and into an unoccupied playing area;

moving a first game piece of the second player diagonally to a contiguous, unoccupied playing area or jumping the first game piece of the second player diagonally over a second game piece of the second player, the second game piece of the second player being of a rank equal to or lower than the rank of the first game piece of the second player, into an unoccupied playing area; and repeating the prior two steps with the additional move option of moving another game piece diagonally to a contiguous, unoccupied playing area or jumping the other piece diagonally over any game piece of a rank equal to or lower than the rank of the other game piece and into an unoccupied playing area while removing any game piece jumped by an opponent's game piece.

2. A method according to claim 1, wherein said repeating step is continued until the highest ranking game piece of one of the players is jumped by an opponent's highest ranking game piece.

3. A method according to claim 1, wherein said repeating step is continued until the highest ranking game piece of each player and no more than one other game piece remains on the game board.

4. A method according to claim 1, wherein the number of playing and non-playing areas in each row of the game board total one of at least three numbers.

5. A method according to claim 1, wherein the areas of the rows are aligned in columns, the game board comprising four columns of three total areas, two columns of five total areas, and five columns of eleven total areas.

6. A method according to claim 1, wherein the ranking indicia of the game pieces comprise numerals.

7. A method according to claim 6, wherein the plurality of game pieces for each player totals twelve, with the ranking indicia of the game pieces for each player being one through twelve.

8. A method according to claim 1, wherein in said repeating step, the other game piece can move diagonally in any direction.

9. A method according to claim 1, wherein in said arranging steps, the game pieces are arranged in seven columns.

10. A method according to claim 1, wherein in said arranging steps, the game pieces are arranged in nine columns.

11. A method of playing a board game by a plurality of players, said method comprising the steps of:

providing a game board divided into rows of playing areas and a plurality of game pieces for each player, wherein the game board comprises two rows of a total of two playing areas, four rows of three playing areas, two rows of a total of four playing areas, two rows of a total of five playing areas and one row of a total of six playing areas, each playing area being diagonally adjacent to at least one other playing area, and each of the game pieces for each player comprises ranking indicia;

arranging the game pieces of a first player on the playing areas of a plurality of rows at one end of the game board;

arranging the game pieces of an opposing, second player on the playing areas of a plurality of rows at another end of the game board;

beginning play by having the first player move a first game piece diagonally to a contiguous, unoccupied playing area or jumping the first game piece of the first player diagonally over a second game piece of the first player, the second game piece of the first player being of a rank equal to or lower than the rank of the first game piece, and into an unoccupied playing area;

moving a first game piece of the second player diagonally to a contiguous, unoccupied playing area or jumping the first game piece of the second player diagonally over a second game piece of the second player, the second game piece of the second player being of a rank equal to or lower than the rank of the first game piece of the second player, into an unoccupied playing area; and repeating the prior two steps with the additional move option of moving another game piece diagonally to a contiguous, unoccupied playing area or jumping the other piece diagonally over any game piece of a rank equal to or lower than the rank of the other game piece and into an unoccupied playing area while removing any game piece jumped by an opponent's game piece.

12. A method according to claim 11, wherein said repeating step is continued until the highest ranking game piece of one of the players is jumped by an opponent's highest ranking game piece.

13. A method according to claim 11, wherein said repeating step is continued until the highest ranking game piece of each player and no more than one other game piece remains on the game board.

14. A method according to claim 11, wherein the number of playing areas in each row of the game board total one of at least five numbers.

15. A method according to claim 11, wherein the areas of the rows are aligned in columns, the game board comprising two columns of one playing area, two columns of two playing areas, two columns of three playing areas, two columns of five playing areas and three columns of six playing areas.

16. A method according to claim 11, wherein the ranking indicia of the game pieces comprise numerals.

17. A method according to claim 16, wherein the plurality of game pieces for each player totals twelve, with the ranking indicia of the game pieces for each player being one through twelve.

18. A method according to claim 11, wherein in said repeating step, the other game piece can move diagonally in any direction.

19. A method according to claim 11, wherein in said arranging steps, the game pieces are arranged in seven columns.

20. A method according to claim 11, wherein in said arranging steps, the game pieces are arranged in nine columns.

21. A method according to claim 11, wherein the playing areas are diagonally adjacent one another.

* * * * *